US006213385B1

(12) United States Patent
Guzowski et al.

(10) Patent No.: US 6,213,385 B1
(45) Date of Patent: Apr. 10, 2001

(54) METHOD OF CLADDING TUBING AND MANUFACTURING CONDENSOR CORES

(75) Inventors: Matthew M. Guzowski, Onsted; Henry McCarbery, Palmyra, both of MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

(21) Appl. No.: 09/339,531

(22) Filed: Jun. 24, 1999

Related U.S. Application Data

(62) Division of application No. 08/918,589, filed on Aug. 19, 1997, now Pat. No. 5,943,772.

(51) Int. Cl.[7] ..... B23K 1/00; B23K 31/02; B23K 35/24; B21D 39/04; B32B 15/10

(52) U.S. Cl. ..... 228/183; 228/232; 228/132; 428/654

(58) Field of Search ..... 228/183, 220, 228/200, 232, 263.15, 132, 263.17; 428/654, 933

(56) References Cited

U.S. PATENT DOCUMENTS

| | | | |
|---|---|---|---|
| 540,768 | | 6/1895 | Western . |
| 2,982,019 | | 5/1961 | Drummond . |
| 3,053,511 | | 9/1962 | Godfrey . |
| 3,078,563 | | 2/1963 | Gould et al. . |
| 3,292,253 | | 12/1966 | Rossner et al. . |
| 3,320,666 | | 5/1967 | Dion . |
| 3,355,796 | | 12/1967 | Freiling, Jr. . |
| 3,389,455 | | 6/1968 | Clark . |
| 3,509,617 | | 5/1970 | Winter . |
| 3,562,899 | | 2/1971 | Stout et al. . |
| 3,616,982 | | 11/1971 | Dion . |
| 4,013,211 | | 3/1977 | Atman . |
| 4,260,095 | | 4/1981 | Smith . |
| 4,753,849 | | 6/1988 | Zohler . |
| 4,911,351 | * | 3/1990 | Ishikawa et al. . |
| 4,917,180 | * | 4/1990 | Wolf et al. . |
| 4,933,141 | * | 6/1990 | Mankins et al. . |
| 4,949,895 | | 8/1990 | Sugiyama et al. . |
| 4,982,784 | * | 1/1991 | Rhodes . |
| 5,014,901 | * | 5/1991 | Moran . |
| 5,056,209 | * | 10/1991 | Ohashi et al. . |
| 5,069,381 | * | 12/1991 | Gibbs et al. . |
| 5,105,540 | | 4/1992 | Rhodes . |
| 5,110,035 | | 5/1992 | Reynolds et al. . |
| 5,118,028 | * | 6/1992 | Ogawa et al. . |
| 5,133,126 | | 7/1992 | Matsuoka . |
| 5,172,476 | | 12/1992 | Joshi . |
| 5,246,064 | * | 9/1993 | Hoshino et al. . |
| 5,316,206 | | 5/1994 | Syslak et al. . |
| 5,445,682 | | 8/1995 | Hasegawa et al. . |
| 5,593,187 | * | 1/1997 | Okuda et al. . |
| 5,709,021 | | 1/1998 | DiCello et al. . |
| 5,744,255 | * | 4/1998 | Doko et al. . |

(List continued on next page.)

FOREIGN PATENT DOCUMENTS

| | | | |
|---|---|---|---|
| 0 940 705 | 9/1999 | (EP) . | |
| 06258522 | 9/1994 | (JP) . | |
| 10240143 | 9/1998 | (JP) . | |
| WO 99/36258 | 7/1999 | (WO) | B32B/7/02 |

OTHER PUBLICATIONS

Wortman, David L., "A Recent Advance In Reflective Polarizer Technology".

*Primary Examiner*—Patrick Ryan
*Assistant Examiner*—Colleen Cooke
(74) *Attorney, Agent, or Firm*—Harness, Dickey & Pierce, P.L.C.

(57) ABSTRACT

A method of manufacturing a clad product in which a metallic substrate material is extruded and a cladding material is then brought into intimate contact with the heated extrudate before the extrudate has had an opportunity to cool to room temperature. The cladding material is compressed against the heated extrudate, thereby bonding the cladding material to the substrate material and forming the clad extruded metallic product. The clad extruded metallic product is then cooled to room temperature.

7 Claims, 2 Drawing Sheets

U.S. PATENT DOCUMENTS 5,813,249 * 9/1998 Matuso et al. .
5,882,774 3/1999 Jonza et al. ..... 428/212
5,940,149 8/1999 Vanderwerf ..... 349/5
5,965,247 10/1999 Jonza et al. ..... 428/212

* cited by examiner

METHOD OF CLADDING TUBING AND MANUFACTURING CONDENSOR CORES

This is a division of U.S. patent application Ser. No. 08/918,589, filed Aug. 19, 1997 now U.S. Pat. No. 5,943, 772.

BACKGROUND AND SUMMARY OF THE INVENTION

This invention is related to a method of cladding tubing and manufacturing condensor cores. The method provides an enhanced bond between the substrate material and the cladding material without requiring complicated and expensive surface preparation processes prior to cladding.

In many applications, it is desirable to utilize metallic products that have an outer surface layer that consists of a different metallic material than the metallic substrate material used to manufacture the remainder of the product. This metallic outer surface layer may, for instance, inhibit corrosion, increase wear resistance, promote thermal transfer, or allow for later manufacturing operations, such as brazing or welding.

A number of methods are known for forming metallic products having a metallic outer surface layer that consists of a different metallic substance than the remainder of the product. In the method described in U.S. Pat. No. 5,172,476, for instance, a sheet of aluminum base material is bonded to a sheet of aluminum-silicone material. This bilaminate sheet material is then roll formed into a tubular shape and the seam where the original outer edges of the sheet material meet is welded to produce aluminum tubing having an aluminum-silicone outer surface layer.

A metallic outer surface layer can also be bonded to the products after the products have already been fabricated. A variety of methods for applying metallic outer surface layers over metallic substrate layers are known in the art.

Surface coating method techniques such as spraying, chemical vapor deposition, physical vapor deposition, and diffusion coating can be used to impart a metallic coating layer over a metallic substrate material. Creating a metallic surface coating by flame spraying is described in U.S. Pat. No. 5,133,126. The method described in this patent can produce aluminum tubing that is covered by an anticorrosive zinc outer surface layer. Creating a metallic surface coating by arc spraying is described in U.S. Pat. No. 4,753,849. The method described in this patent can produce copper tubing having a zinc/copper pseudo alloy outer surface layer. Metallic surface layers can also be provided over a metallic substrate material by electroplating, dip coating, galvanizing and similar techniques.

Another method for providing a product with a metallic outer surface layer is referred to as cladding. In a cladding process, metallic cladding material in solid form is brought into contact with the outer surface of the product and pressure is applied which solid-state bonds the metallic cladding material to the metallic substrate material. Several methods for cladding metallic products are known.

In the method described in U.S. Pat. No. 3,616,982, a wire-like core material passes through an annular shaving die to expose a virgin metal surface and then passes through a manifold having a protective or oxide-reducing atmosphere. Cladding material is brought into contact with the core material and peripherally grooved rolls squeeze the cladding material against the core material and bond the cladding to the core entirely around the periphery of the core.

In the method described in U.S. Pat. No. 3,389,455, tubing is heated as it passes through a retort that has an inert or reducing atmosphere. Powderized metallic cladding materials are then brought into contact with the tubing and the materials are squeezed and compressed. The squeezed and compressed assembly is then sintered to complete the cladding process.

In the method described in U.S. Pat. No. 5,056,209, an inner pipe (i.e. the metallic substrate material) is placed within an outer pipe (i.e. the metallic cladding material) to produce a combined billet. The billet is then heated and subjected to a hot extrusion process. The hot extrusion process deforms the billet and bonds the metallic cladding material to the metallic substrate material.

A problem inherent in those cladding methods which clad a product after the product has already been fabricated is that many metallic materials can form tenacious surface oxide layers when exposed to the atmosphere or other oxidizing environments. Other materials, such as adsorbed gas films or lubricant residues, can also contaminate the outer surface of the product between the product fabrication process and the cladding process. These contaminates can prevent the formation of interatomic bonds that are essential to obtaining a sufficient solid-state bond between the metallic substrate material and the metallic cladding material during the cladding process.

To reduce the quantity of oxides and other contaminates present on the outside of the products prior to the cladding process, other prior art cladding methods employ complicated and expensive surface treatment methods in an attempt to assure that substantial fresh material is present on the outer surface of the product when the metallic substrate material and the metallic cladding material are brought into contact. In these methods, the surface treatment process may consist, for instance, of heating the product in an inert or reducing atmosphere; shaving, brushing, or scraping the outer surface of the product; or treating the outer surface of the product with degreasing solvents or an aqueous sodium hydroxide solution. Each of these methods are intended to increase the amount of fresh metallic substrate material surface present when the metallic cladding material is brought into contact with the metallic substrate material. As seen in the above mentioned '982 patent, a virgin metal surface is preferred. The application of an antioxidizing compound to the metallic substrate material, such as the application of a oxidation preventing petroleum-based coating, can successfully inhibit the formation of the surface oxide layers. This antioxidizing compound, however, then itself becomes a contaminate that inhibits the proper bonding between the metallic substrate material and the metallic cladding material unless it is completely removed prior to the cladding process.

Some cladding methods effectively disrupt the contaminated outer surface layer by deforming the product after the cladding material has been brought into contact with the product. In cladding methods that employ powdered metallic cladding materials, such as described in U.S. Pat. No. 3,389,455, the particles of the powder will tend to bite into the surface of the metallic substrate material, which will help to break through the thin oxide film formed on the outside of the product. In cladding methods that employ a hot extrusion process after the cladding material has been placed into contact with the substrate material, such as described in U.S. Pat. No. 5,056,209, the original outer surface of the substrate material is stretched as it is deformed. This produces a substantial amount of fresh material surface to which the cladding material can effectively bond.

The quantity of contaminates present on the outside surfaces of the products will depend, of course, on the amount of time and types of conditions the products were subjected to after they were fabricated. To assure that a proper material surface is present, it is typically necessary to "overprepare" the outer surface of the products to be relatively certain that any quantity of contaminates that could be reasonably expected to be present on the outer surface of the products has been thoroughly removed. These surface preparation processes often introduce significant expense to the overall manufacturing cost of the products.

An improved method for manufacturing clad extruded products is therefore desirable to assure that a strong consistent bond is obtained between the metallic substrate material and the metallic cladding material and to eliminate the need for complicated and expensive surface preparation treatments prior to the cladding process.

The present inventive method for manufacturing clad extruded metallic products takes advantage of the fact that when metallic products are extruded using an unlubricated extrusion process, a dead-metal zone is created and material flow takes place by shearing the material along the surface of this zone. The extruded product thereby acquires a completely freshly formed exterior surface which is free of oxides, lubricants, absorbed gas films, and other contaminates. This freshly formed surface offers an ideally prepared surface for a subsequent cladding process. If the metallic cladding material is brought into intimate contact with the freshly formed surface on the outside of the extrudate promptly after the extrudate has been discharged from the extrusion die, no cleaning or subsequent surface preparation treatment of the exterior of the product is required.

By cladding the products promptly after the hot extrusion process, a bond can be produced between the metallic substrate material and the metallic cladding material and the need for complicated and expensive surface preparation treatments prior to the cladding process is eliminated.

A further aspect of this inventive method is the manufacturing of condenser cores. In this process, the cladding is applied to an extruded tube as outlined above and then cooled to room temperature. Fin stock is then positioned in close-fit engagement about the cladded tubing and the cladding material itself is utilized as the brazing/soldering material, depending on the securement method. For example, the initially assembled fin stock and clad tubing can be provided into a brazing furnace where the cladding material is drawn by capillary action into the joint gap to form the fillet. In a soldering process, the cladding material is utilized as the solder.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
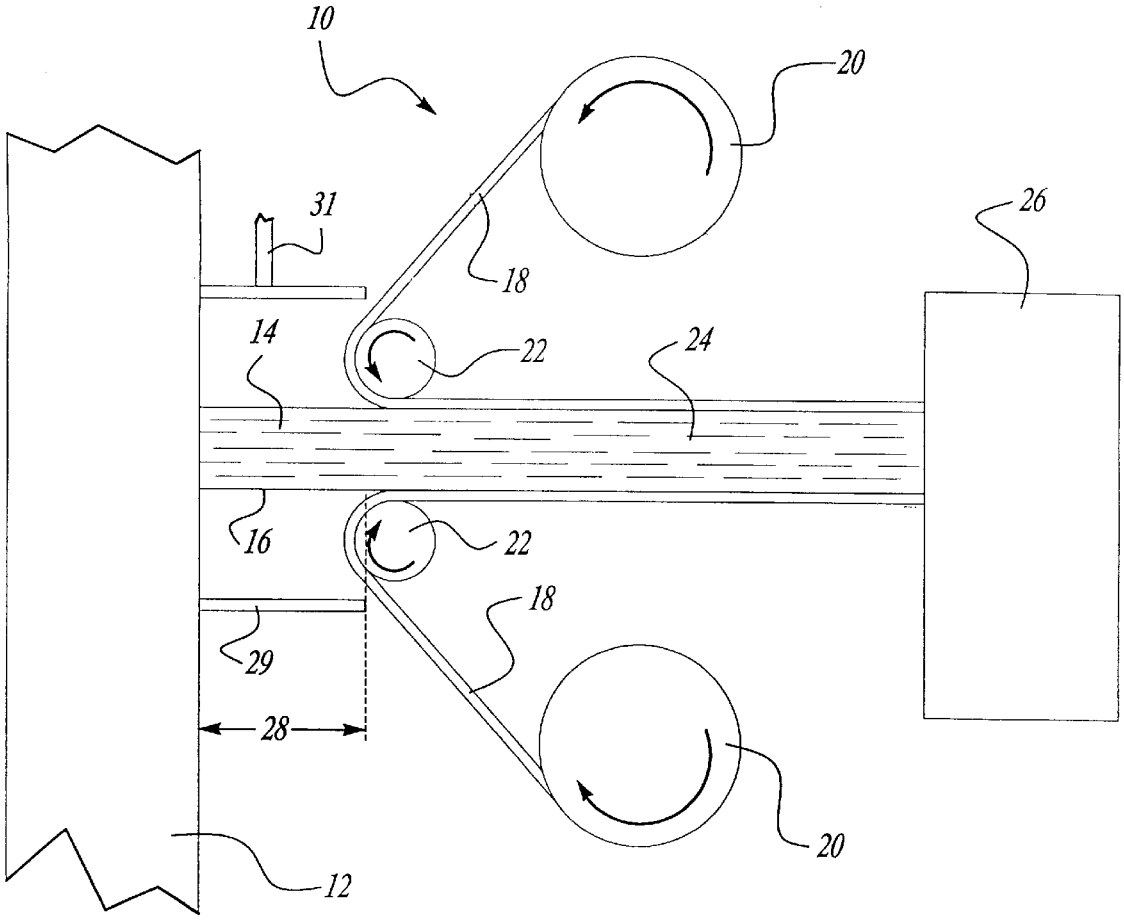
FIG. 1 is a schematic diagram illustrating one embodiment of the inventive method of manufacturing clad extruded metallic products.
Figure 2:
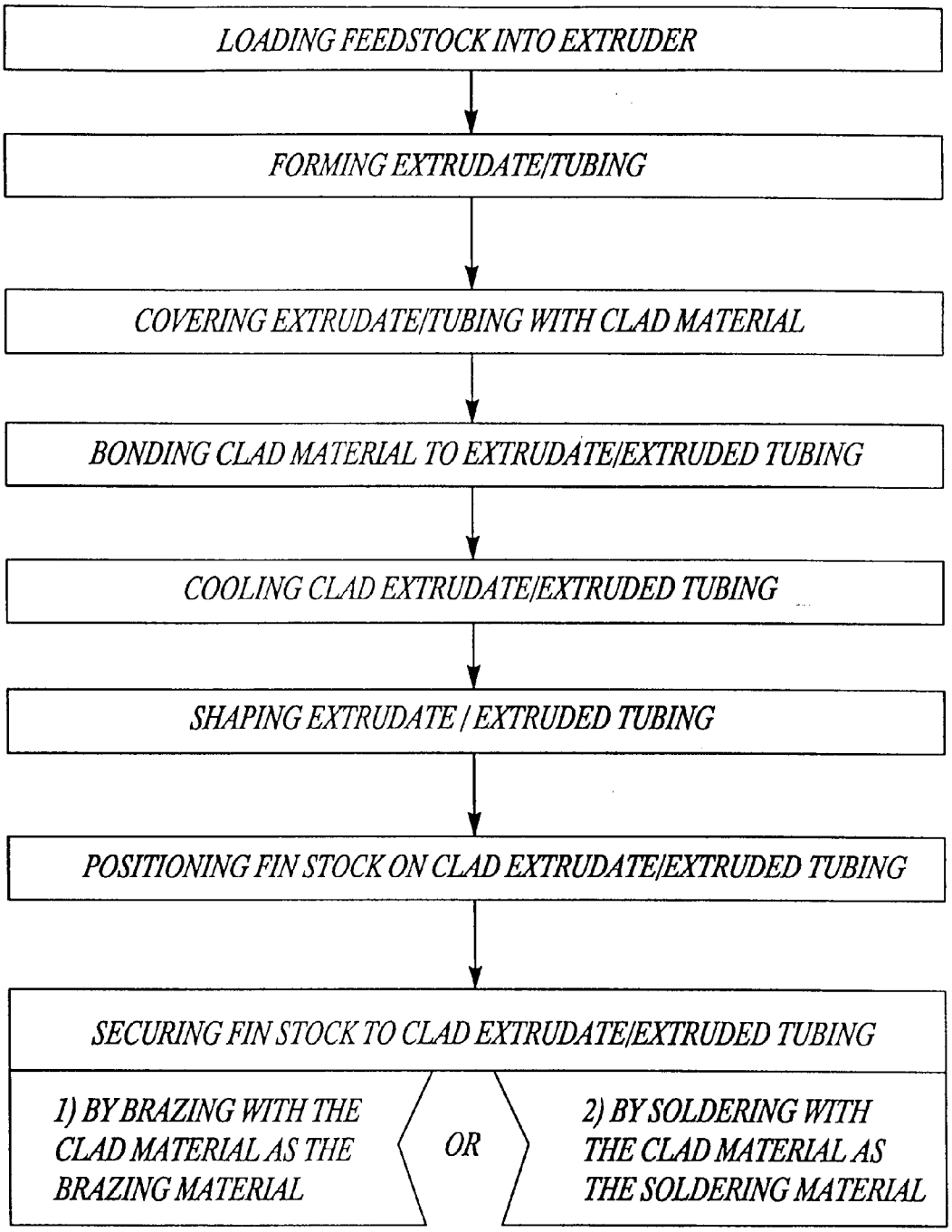
FIG. 2 is a schematic diagram, illustrating the inventive methods for manufacturing condensor cores.

Referring now to the drawings, one embodiment of the present inventive method for cladding tubing is shown in FIG. 1 and is generally designated by reference number 10. In the inventive manufacturing method 10, an appropriate metallic substrate material, such as aluminum, an aluminum-based alloy, copper, brass or other metal or metal alloy, is first heated within manufacturing equipment capable of carrying out a hot extrusion process, such as an extrusion press 12. The metallic substrate material is then extruded by the extrusion press 12, typically through an appropriately designed die, to form heated extrudate 14, such as tubing. Because the extrusion press 12 performs what is referred to as unlubricated extrusion, the extrusion die creates a dead metal zone within the press. The metallic substrate material that exits the extrusion press 12 is required to shear along the surface of this dead metal zone. As it shears along the surface of the dead metal zone, any surface oxide layers or contaminates on the outer surface of the original billet of metallic substrate material are subsumed into the body of the heated extrudate 14 and the outside surface of the extrudate consists exclusively of freshly formed surface material. This freshly formed material on the external surface of the heated extrudate 14 is referred to herein as the outer surface 16 of the extrudate.

The metallic cladding material, which is shown as a cladding foil 18 in FIG. 1, is provided from a cladding supply system, such as foil rolls 20. The cladding foil 18 is brought into intimate contact with the outer surface 16 of heated extrudate 14, such as by a pair of rollers 22 which press the foil 18 against the still hot extrudate 14, immediately after the heated extrudate has been discharged from the extrusion press 14. Rollers 22 would typically be motor driven, with the rate of rotation being tied to the rate that the heated extrudate 14 being discharged from the extrusion press 12. To reduce the possibility of contaminating the outer surface 16 of the heated extrudate 14, it is desirable to have the area between the point at which the heated extrudate 14 is discharged from the extrusion press 12 and the point at which the outer surface 16 of the heated extrudate 14 is contacted by cladding foil 18 be as short as possible. This area is designated in FIG. 1 as extrudate exposure area 28. It is desirable to reduce both the distance and time that the heated tubing extrudate 14 is present within extrudate exposure area 28 to limit the opportunity for the outer surface 16 of the heated extrudate 14 to form surface oxide layers or to be otherwise contaminated.

It is theoretically desirable to eliminate extrudate exposure area 28 completely and to bring cladding foil 18 into intimate contact with heated tubing extrudate 14 at the precise instant the heated extrudate is discharged from the extrusion press 12. In practice, this is often physically impractical or impossible due to equipment and processing constraints and some form of extrudate exposure area 28 will be necessary or desirable. To reduce the opportunity for the outer surface 16 of the heated tubing extrudate 14 to form surface oxide layers or to be otherwise contaminated, it is desirable to shield the heated tubing extrudate 16 to prevent external contaminates from coming into contact with the heated extrudate. If the metallic substrate material is particularly likely to form surface oxide layers or absorbed gas films, it may also be desirable to introduce a controlled atmosphere into the extrudate exposure area 28. The controlled atmosphere could incorporate a gas, such as nitrogen gas, that is not readily absorbed into the particular metallic substrate material and which does not readily form chemical compounds with the metallic substrate material. A housing 29 and gas supply 31 may therefore be required.

As seen from the above, the cladding foil 18 and the heated extrudate 14 are bonded together producing a metallurgical bond between the foil 18 and heated extrudate 14 resulting in the clad product 24, a clad tubing. The best bonds between the metallic substrate material and the metallic cladding material will be obtained between metals that have atomic registry (i.e. where the atoms of the two components are similarly spaced and crystallize in the same lattice structure). The metallic substrate material and the metallic cladding material will therefore bond best when they are able to form solid solutions with each other.

The bond obtained between the metallic substrate material and the metallic cladding material is enhanced by the fact that the hot extrudate 14 has not cooled to room temperature and is still comparatively soft as the rollers 22 contact the cladding foil 18 with the hot extrudate. The heat transferred from the hot extrudate 14 to the metallic cladding material also tends to soften the metallic cladding material. This softening promotes the intimate contact and diffusion of atoms that is necessary to achieve proper bonding between the metallic substrate material and the metallic cladding material.

After bonding of the foil 18 to the extrudate 14, clad product 24 is quenched in quenching unit 26 and cooled to room temperature.

The cladding foil 18 will typically be bonded to the entire outer surface 16 of the heated extrudate 14, although it is possible to clad only a portion of this outer surface 16 with the cladding foil 18. While the cladding foil 18 being provided by the two rolls 20 would typically consist of the same type of material, it is also possible to bond foils of different cladding materials to opposite sides of the heated extrudate 14, if desired.

The cladding foil 18 can be any of the materials used for cladding and the particular material will depend on the end use or subsequent processing parameters. If the clad product 24 is intended to be further assembled with other components, the cladding foil 18 may, for instance, comprise a 4XXX series brazing alloy. If the clad product 24 is later to be soldered to another component, the cladding foil 18 may be one of the various soldering alloys. This zinc-based alloy could also be used to impart corrosion protection on the clad product 24.

While the embodiment of the inventive manufacturing method 10 illustrated in FIG. 1 particularly shows the use of foil form metallic cladding material and the roll bonding of the metallic cladding material to produce clad extruded metallic tubing, it should be understood that other embodiments of the inventive manufacturing method could be used to manufacture other types of clad extruded metallic products and these embodiments could incorporate cladding equipment and processes other than the foil cladding material and bonding method illustrated in FIG. 1. The shape of the clad extruded metallic products that can be manufactured using the inventive manufacturing method 10 is almost infinite and includes round, oblong, square or rectangular tubes, shapes, sheets or bars. The inventive manufacturing method 10 can also be utilized in connection with alternative cladding equipment and processes that are known to those of ordinary skill in the art. The cladding equipment and process disclosed in U.S. Pat. No. 3,389,455, which utilizes a powdered metallic cladding material, could effectively be used, for instance, with the inventive manufacturing method 10 in place of the cladding foil 18, the foil rolls 20 and the rollers 22.

Another aspect of this invention is a method of manufacturing a condensor core. In manufacturing a condenser core according to the present invention, aluminum or another suitable material is fed into an extrusion press where it is extruded in the form of a tubing. Immediately after it has been extruded, the still heated tubing is clad with foil material as described above so as to metallurgically bond the foil to the tubing forming clad extruded tubing. The clad extruded tubing is next quenched and cooled.

Once cooled, the clad extruded tubing is cut to length , bent into the desired shape and fin stock is positioned onto the clad extruded tubing. Generally the fin stock will be provided with openings or slots that will allow the clad extruded tubing to be received thereinto. For reasons set out below, the clad extruded tubing and fin stock are in close-fit engagement with one another. In one embodiment, the tubing and fin stock are then located in a brazing furnace with a protective $N_2$ atmosphere. The cladding is caused to melt and is drawn by capillary action into the joint areas (defined by the slots between the fin stock and the tubing) to form the fillets. Preferably in such a brazing operation, the cladding material is a 4XXX series brazing alloy, such as 4047 or 4343.

In another embodiment, the clad extruded tubing is soldered to the fin stock. When soldering is employed, the cladding material is preferably a soldering alloy such as one comprised of 95% zinc and 5% aluminum, which would further impart corrosion resistance to the condenser core.

It is to be understood that the invention is not limited to the exact construction illustrated and described above, but that various changes and modifications may be made without departing from the spirit and scope of the invention as defined in the following claims.

What is claimed is:

1. A method of manufacturing a condensor core comprising the steps of:

heating a feed stock material;

extruding said feed stock material to form heated tubing extrudate having an outer surface;

bringing a cladding material into intimate contact with said outer surface of said heated tubing extrudate before said heated tubing extrudate has cooled to room temperature and immediately after said extrudate has been extruded in the extruding step;

compressing said cladding material against said outer surface of said heated tubing extrudate;

forming a metallurgical bond between said cladding material and said heated tubing to form a clad extruded tubing;

cooling said clad extruded tubing; cutting said clad extruded tubing to a predetermined length;

shaping said clad extruded tubing into a predetermined shape;

positioning fin stock about said clad extruded tubing in close-fit contact therewith; and securing said fin stock to said clad extruded tubing by forming a fillet between said fin stock and said clad extruded tubing, said fillet being formed at least partially out of said cladding material.

2. The method of claim 1 wherein said fin stock is secured to said clad extruded tubing by brazing.

3. The method of claim 1 wherein said fin stock is secured to said clad extruded tubing by soldering.

4. The method of claim 1 wherein said cooling step comprises quenching of said clad extruded metallic product.

5. The method of claim 1 wherein said extruding step is an unlubricated extrusion process.

6. The method of claim 1 wherein said cladding material is provided as a zinc-based alloy.

7. The method of claim 1 wherein said cladding material is provided as an aluminum-based alloy.

* * * * *